US008242712B2

(12) United States Patent
Chen et al.

(10) Patent No.: US 8,242,712 B2
(45) Date of Patent: Aug. 14, 2012

(54) POWER SUPPLY APPARATUS

(75) Inventors: Wen-Sheng Chen, Taipei (TW); Chung-Chih Chen, Taipei Hsien (TW); Yeh Guan, Taipei County (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 449 days.

(21) Appl. No.: 12/503,864

(22) Filed: Jul. 16, 2009

(65) Prior Publication Data

US 2010/0109561 A1 May 6, 2010

(30) Foreign Application Priority Data

Oct. 30, 2008 (TW) ..... 97219374 U

(51) Int. Cl.
*H05B 37/02* (2006.01)

(52) U.S. Cl. ..... 315/307; 315/224; 315/291

(58) Field of Classification Search ..... 315/291, 315/194, 199, DIG. 4, 294, 299, 225, 226
See application file for complete search history.

(56) References Cited

U.S. PATENT DOCUMENTS 5,872,429 A * 2/1999 Xia et al. ..... 315/194
2006/0071614 A1* 4/2006 Tripathi et al. ..... 315/291
* cited by examiner

*Primary Examiner* — Shawki S Ismail
*Assistant Examiner* — Christopher Lo
(74) *Attorney, Agent, or Firm* — Li & Cai Intellectual Property (USA) Office

(57) ABSTRACT

A power supply apparatus includes an open loop power switcher, a power isolation transformer, a backlight driving circuit, and a power circuit. The open loop power switcher converts a direct current (DC) power into an alternating current (AC) input voltage. The power isolation transformer is coupled to the open loop power switcher and includes a primary-side winding, a first winding, and a second winding, wherein the first and second windings are disposed at the secondary-side of the power isolation transformer, and the first winding is employed for generating a first voltage signal according to the AC input voltage. The backlight driving circuit is employed for driving a backlight module according to the first voltage signal. The power circuit is employed for receiving a second voltage signal generated from the second winding according to the AC input voltage, in order to generate an output power signal.

14 Claims, 11 Drawing Sheets

POWER SUPPLY APPARATUS

BACKGROUND OF THE INVENTION

The present invention relates to a power supply apparatus, and more particularly to a power supply apparatus incorporating a backlight driving circuit and a power circuit to share a same transformer and a same power switcher.

FIELD OF THE INVENTION

The present invention relates to a power supply apparatus, and more particularly to a power supply apparatus incorporating a backlight driving circuit and a power circuit to share a same transformer and a same power switcher.

DESCRIPTION OF THE PRIOR ART

Most recent large-scale LCD TVs still utilize cold cathode fluorescent lamps as backlights. The cold cathode fluorescent lamp introduced in an LCD TV is generally driven by an internal lamp inverter while the other portions of circuitry in the LCD TV are driven by a system power; that is, there are distinct ways of supplying power to the lamp inverter and to the other portions of circuitry in the LCD. Moreover, output voltages of the system power are typically 24V, 12V, 5V, and the output voltage of a standby power is 5V.

In addition to the above-mentioned power supplying methods, a 2-in-1 switching power supply is also seen in commercial fields, wherein the 2-in-1 switching power supply means that the lamp inverter and the system power are incorporated. Please refer to FIG. 1, which illustrates a block diagram of a 2-in-1 switching power supply apparatus 100 introduced in conventional LCD TVs. The 2-in-1 switching power supply apparatus 100 includes an AC-DC converter 105, a lamp inverter 110, a DC-DC Converter 115 for supplying a system power, and a DC-DC Converter 120 for supplying a standby power, wherein the lamp inverter 110 is utilized for providing voltages required by a plurality of lamps $L_1$-$L_N$. Also, the lamp inverter 110 includes a power switcher 125*a*, a transformer 130*a*, a high voltage transformer array 135, and a feedback and driving circuit 140*a*. The DC-DC Converter 115 supplies the system power $VO_1$-$VO_M$ required by the other portions of circuitry in the LCD TV. The DC-DC Converter 115 includes a power switcher 125*b*, a transformer 130*b*, a rectifier and filter array 136, and a feedback and driving circuit 140*b*. The DC-DC Converter 120 provides a standby power VSS, and includes a power switcher 125*c*, a transformer 130*c*, a rectifier and filter circuit 137, and a feedback and driving circuit 140*c*. Due to the needs of three independent transformers 130*a*~130*c*, three independent power switchers 125*a*~125*c*, and three independent feedback and driving circuits 140*a*-140*c* between the primary-side winding and the secondary-side, the hardware costs of the 2-in-1 switching power supply apparatus 100 is quite high. Moreover, as the system power introduces a fly-back conversion scheme and operates with a relatively low duty ratio, the transformer 130*b* of the DC-DC converter 115 reduces the entire power conversion efficiency of the 2-in-1 switching power supply apparatus 100. Also, high component count means the 2-in-1 switching power supply apparatus 100 is formed with a larger size.

SUMMARY OF THE INVENTION

Thus, to eliminate the drawbacks of the conventional 2-in-1 switching power supply apparatus, such as higher costs, lower power conversion efficiency, and more components, one objective of the present invention is to provide an improved 2-in-1 power supply apparatus having low hardware cost, high power conversion efficiency, and fewer components in order to provide power for backlights that utilize cold cathode fluorescent lamps or external electrode fluorescent lamps in liquid crystal products.

The embodiments of the present invention are not only applied to backlights using fluorescent lamps. In other words, another important objective of the present invention is to provide a power supply apparatus incorporating a backlight driving circuit and a power circuit (such as a power circuit supplying a system power or a standby power) which share a same transformer and a same power switcher, thereby gaining a competitive edge with regards to hardware costs, power conversion efficiency, and number of components.

According to one exemplary embodiment of the present invention, a power supply apparatus is disclosed. The power supply apparatus includes an open loop power switcher, a power isolation transformer, a backlight driving circuit, and a power circuit, wherein the open loop power switcher converts a direct current (DC) power into an alternating current (AC) input voltage; the power isolation transformer is coupled to the open loop power switcher and includes a primary-side winding, a first winding and a second winding, wherein the first and second windings are disposed at a secondary-side of the power isolation transformer and the first winding is employed for generating a first voltage signal according to the AC input voltage; and the backlight driving circuit is coupled to the first winding of the power isolation transformer, and is employed for driving a backlight module according to the first voltage signal. The power circuit is coupled to the second winding of the power isolation transformer, and is employed for receiving a second voltage signal generated from the second winding according to the AC input voltage in order to generate an output power signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
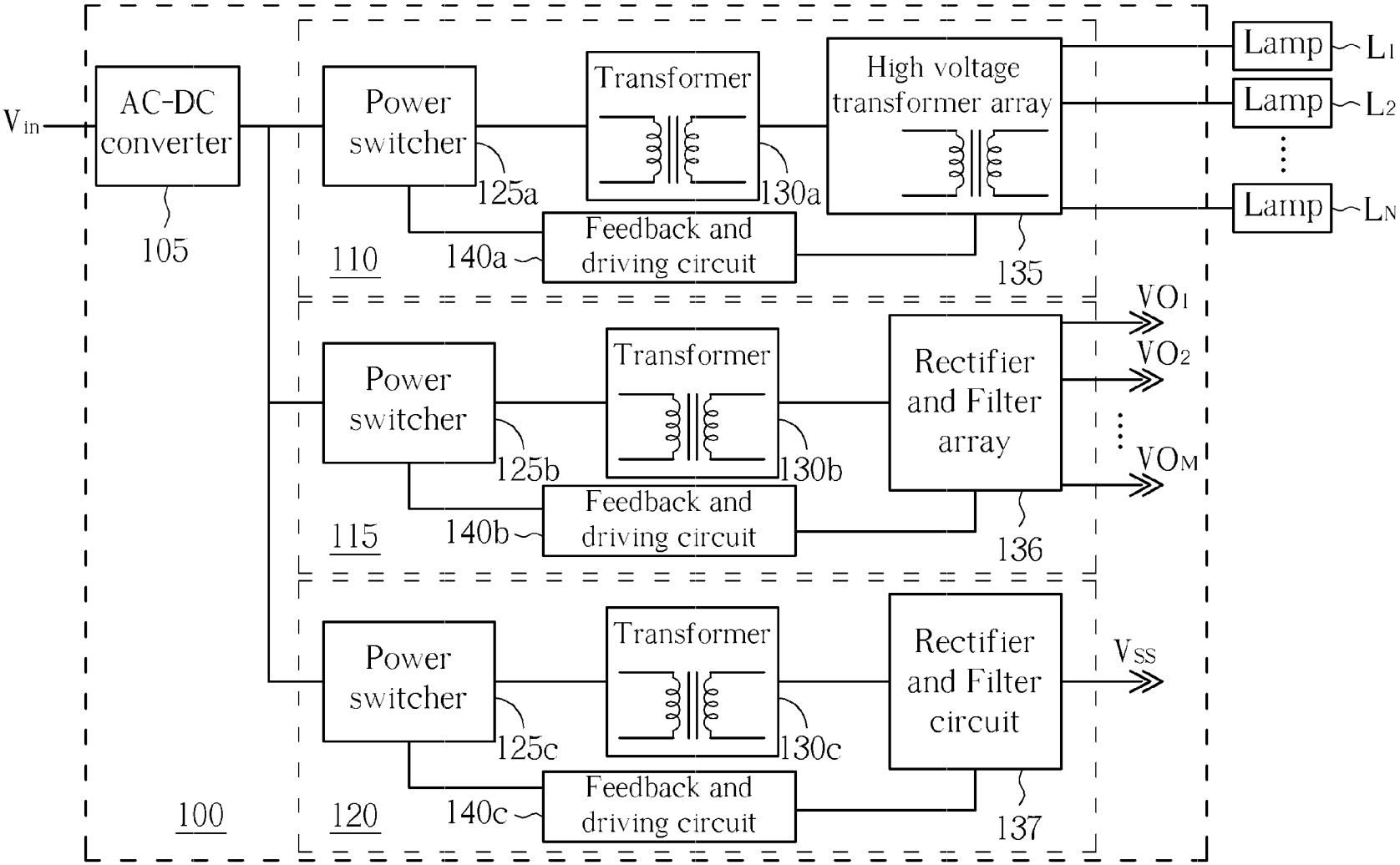
FIG. 1 is a block diagram of a 2-in-1 switching power supply apparatus introduced in a conventional LCD TV.
Figure 2A:
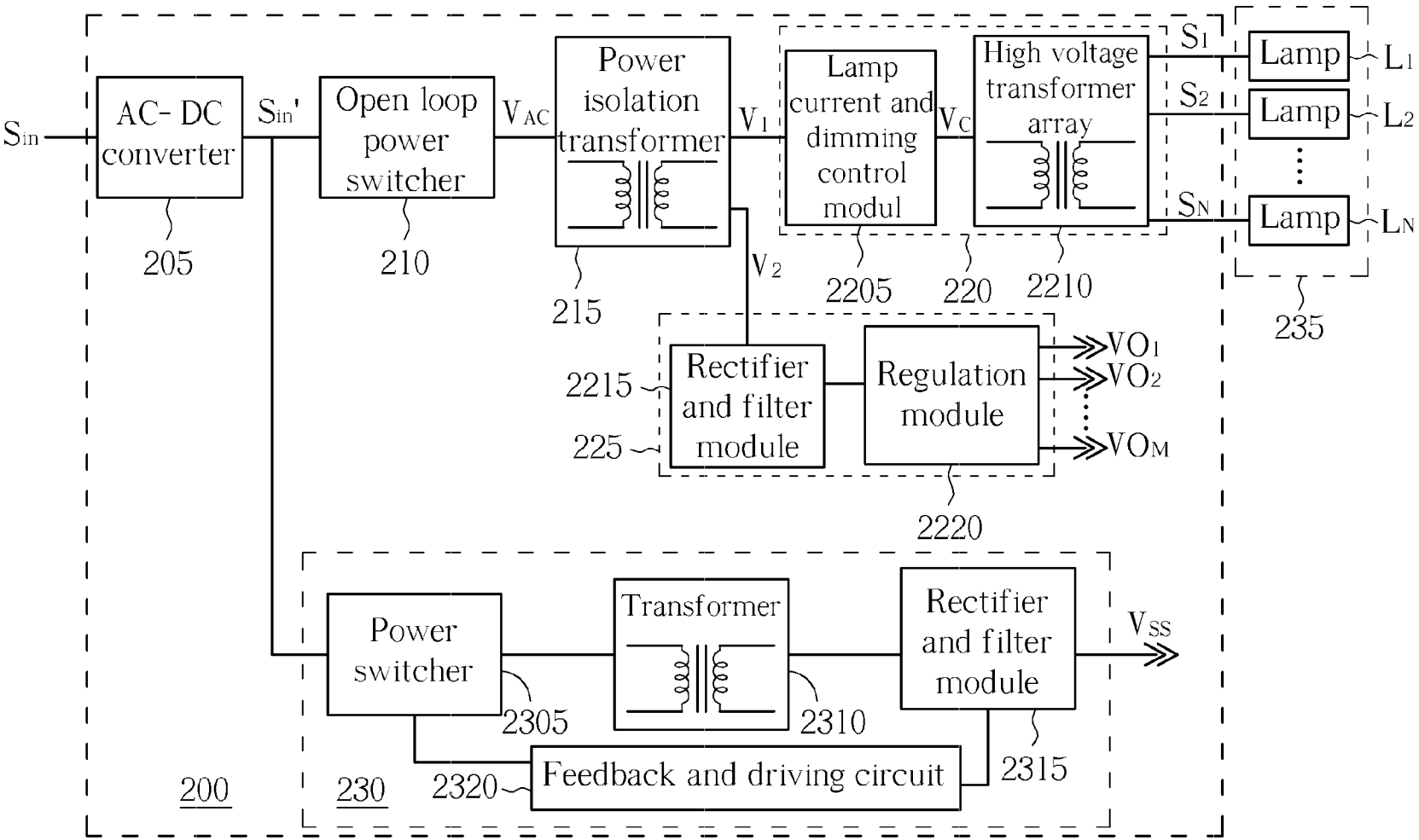
FIG. 2A is a diagram of a power apparatus according to a first exemplary embodiment of the present invention.

Please refer to FIG. 2A, which illustrates a diagram of a power supply apparatus 200 according to a first exemplary embodiment of the present invention. The power supply apparatus 200 includes an AC-DC converter 205, an open loop power switcher 210, a power isolation transformer 215, a backlight driving circuit 220, a power circuit 225, and a DC-DC converter 230 which provides a standby power $V_{SS}$. The open loop power switcher 210 provides an AC input voltage $V_{AC}$ according to a DC power $S_{in}'$ that is converted and output by the AC-DC converter 205. The power isolation transformer 215 is coupled to the open loop power switcher 210 and includes a primary-side winding, a first winding, and a second winding (not shown in FIG. 2A for the sake of brevity). The first and second windings are disposed at a secondary-side of the power isolation transformer 215. The first winding generates a first voltage signal $V_1$ according to the AC input voltage $V_{AC}$. Additionally, the backlight driving circuit (also called the lamp driving circuit) 220 is coupled to the first winding of the power isolation transformer 215, and drives a plurality of lamps $L_1$-$L_N$ of the backlight module 235 according to the first voltage signal $V_1$. The power circuit 225 is coupled to the second winding of the power isolation transformer 215, and receives a second voltage signal $V_2$ which is generated by the second winding in accordance with the AC input voltage $V_{AC}$ for the purpose of generating one or more output power signals. In this exemplary embodiment, a plurality of output power signals $VO_1$-$VO_M$ (actually voltage signals) is generated. Moreover, the operation and function regarding the DC-DC converter 230 in FIG. 2A is similar to that of the DC-DC converter 120 shown in FIG. 1, so detailed descriptions are omitted here.

As shown in the figure, the backlight driving circuit 220 and the power circuit 225 respectively provide voltages $VO_1$-$VO_M$ desired by the lamps $L_1$-$L_N$ and by the system power. The backlight driving circuit 220 and the power circuit 225 share the same open loop power switcher 210 and the same power isolation transformer 215, causing the power supply apparatus 200 to be of low cost, high power conversion efficiency, and low complexity. Due to this sharing of components, the open loop power switcher 210, the power isolation transformer 215, and backlight driving circuit 220 can be deemed as a lamp inverter inside the power supply apparatus 200. The open loop power switcher 210, the power isolation transformer 215, and the power circuit 225 can be deemed as a system power of the power supply apparatus 200.

More specifically, the backlight driving circuit 220 comprises a lamp current and dimming control module 2205 and a lamp driving module 2210, and the power circuit 225 comprises a rectifier and filter module 2215 and a regulation module 2220. The lamp current and dimming control module 2205 is employed for receiving the first voltage signal $V_1$ to generate a voltage control signal $V_C$ which is employed for controlling the current and luminance of the lamps $L_1$-$L_N$. In this embodiment, the lamp driving module 2210 is a high voltage transformer array and generates a plurality of first output driving signals according to the voltage control signal in order to respectively drive the lamps $L_1$-$L_N$ directly; herein the backlight driving circuit 220 can be regarded as a single-push lamp driving circuit. The rectifier and filter module 2215 is coupled to the second winding of the power isolation transformer 215, and is employed for rectifying the second voltage signal $V_2$ and filtering the rectified second voltage signal to eventually provide the output voltages $VO_1$-$VO_M$. Furthermore, the regulation module 2220 is coupled to the rectifier and filter module 2215, and is employed for regulating the output voltages $VO_1$-$VO_M$ generated from the rectifier and filter module 2215.

Compared with the conventional power supply apparatus 100, since the open loop power switcher 210 is designed as an open-loop circuit, it is able to be shared by the backlight driving circuit 220 and the power circuit 225. In other words, the power supply apparatus 200 does not feedback the signal regarding the secondary-side of the power isolation transformer 215 (e.g. the voltage signal $V_1$ generated from the first winding) to the open loop power switcher 210 for performing operations of lamp current control and dimming control, but instead employs the lamp current and dimming control module 2205 at the secondary-side of the power isolation transformer 215 for performing operations of lamp current control and dimming control directly. As a result, in this exemplary embodiment, the power supply apparatus 200 still has a competitive edge of fewer components by sharing the same open loop power switcher 210 and the same power isolation transformer 215, though it includes the additional lamp current and dimming control module 2205.

Figure 2B:
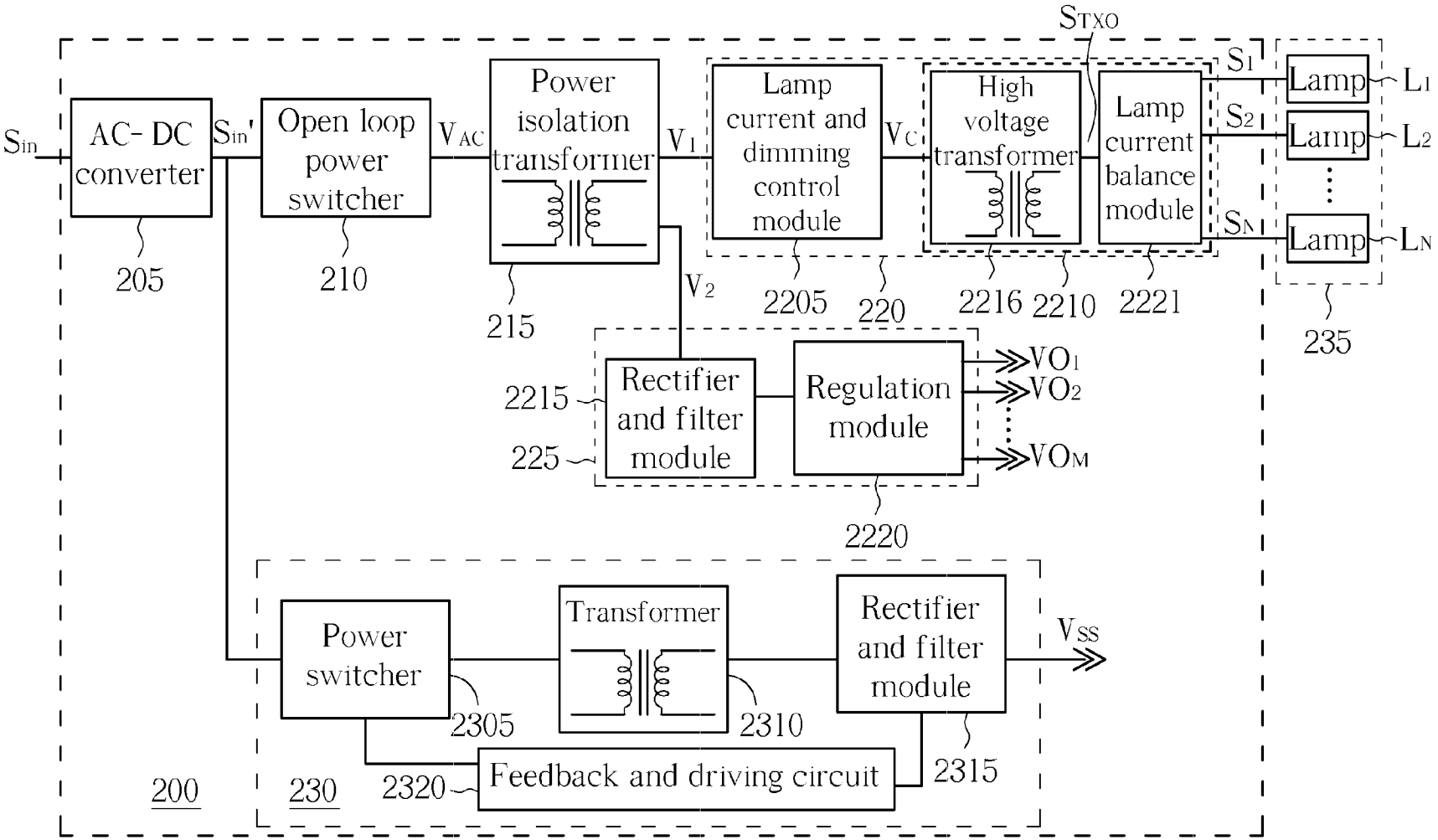
FIG. 2B is a diagram of a power apparatus according to a second exemplary embodiment of the present invention.
Figure 2C:
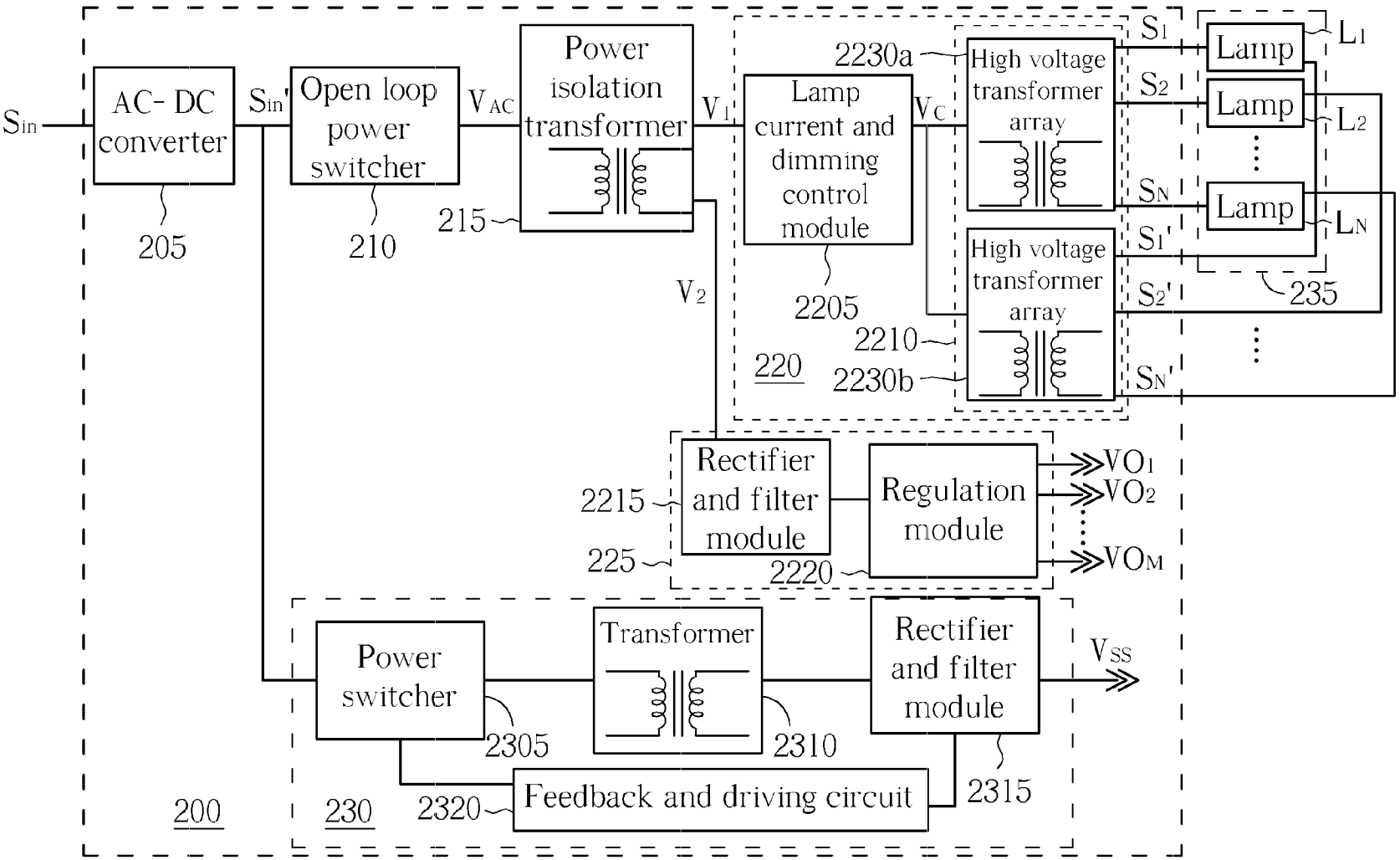
FIG. 2C is a diagram of a power apparatus according to a third exemplary embodiment of the present invention.
Figure 2D:
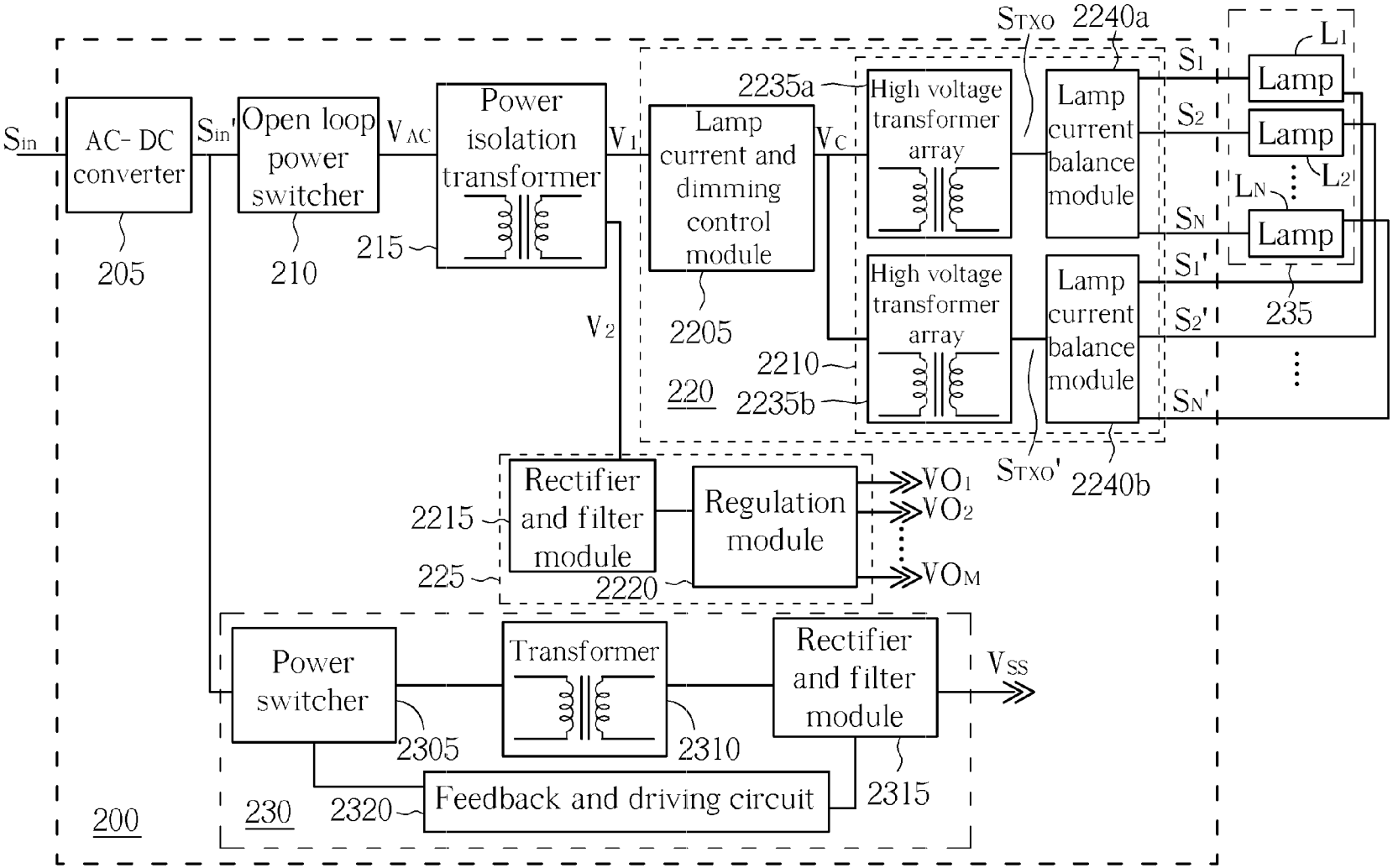
FIG. 2D is a diagram of a power apparatus according to a fourth exemplary embodiment of the present invention.

Other modifications of the power supply apparatus 200 can be seen in FIG. 2B-2D, which respectively illustrate diagrams of the power supply apparatus 200 according to second, third, and fourth exemplary embodiments of the present invention. First, referring to FIG. 2B, the biggest difference between the second exemplary embodiment and the first exemplary embodiment is that the lamp driving module 2210 contains a high voltage transformer 2216 and a lamp current balance module 2221, wherein the high voltage transformer 2216 is coupled to the lamp current and dimming control module 2205, and is employed for generating a transformer output signal $S_{TXO}$ according to the voltage control signal $V_C$. The lamp current balance module 2221 is coupled to the high voltage transformer 2216, and is employed for generating a plurality of first output driving signals $S_1$-$S_N$ according to the transformer output signal $S_{TXO}$ in order to drive the plurality of the lamps $L_1$-$L_N$. The lamp driving module 2210 employs the high voltage transformer 2216 and the lamp current balance module 2221 to respectively drive the lamps $L_1$-$L_N$, which is different from the high voltage transformer array introduced in the first exemplary embodiment shown in FIG. 2A. The operations regarding other portions of circuitry shown in FIG. 2B are the same as those in FIG. 2A except for the high voltage transformer 2216 and the lamp current balance module 2221.

Furthermore, referring to FIG. 2C, the main difference between the third exemplary embodiment and the first exemplary embodiment is that the lamp driving module 2210 shown in FIG. 2C contains two high voltage transformer arrays 2230*a* and 2230*b*, wherein the high voltage transformer array 2230*a* is coupled to the lamp current and dimming control module 2205, and is employed for respectively generating a plurality of transformer output signals into each first terminal of the plurality of the lamps $L_1$-$L_N$ according to the voltage control signals $V_C$ in order to generate output driving signals $S_1$-$S_N$ to drive the plurality of the lamps $L_1$-$L_N$. Additionally, the high voltage transformer array 2230*b* is coupled to the lamp current and dimming control module 2205, and is employed for respectively generating a plurality of second transformer output signals into each second terminal (another terminal) of the plurality of the lamps $L_1$-$L_N$ according to the voltage control signal $V_C$ in order to generate output driving signals $S_1'$-$S_N'$ to drive the plurality of the lamps $L_1$-$L_N$. To put it precisely, the backlight module 235 could use longer lamps $L_1$-$L_N$, so the lamp driving module 2210 is designed to include two high voltage transformer arrays 2230*a* and 2230*b* for respectively driving the lamps $L_1$-$L_N$ directly from two opposite terminals of each lamp so that the luminance of every part of the lamps $L_1$-$L_N$ is closer to uniform. Please note that the backlight driving circuit 220 herein can be regarded as a push-push lamp driving circuit. The operations regarding other portions of circuitry shown in FIG. 2C are the same as those in FIG. 2A except for the high voltage transformer arrays 2230*a* and 2230*b*, so detailed descriptions are omitted here for the sake of brevity.

Referring to FIG. 2D, the main difference between the fourth exemplary embodiment and the first exemplary embodiment is that the lamp driving module 2210 shown in FIG. 2D includes two high voltage transformers 2235*a* and 2235*b* and two lamp current balance modules 2240*a* and 2240*b*, wherein the high voltage transformers 2235*a* and 2235*b* are respectively coupled to the lamp current and dimming control module 2205, and are respectively employed for generating a first and a second transformer output signal $S_{TXO}$ and $S_{TXO}'$ according to the voltage control signal $V_C$. The lamp current balance module 2240*a* is coupled to the high voltage transformer 2235*a*, and is employed for respectively generating a plurality of output driving signals $S_1$-$S_N$ into each first terminal of the plurality of the lamps $L_1$-$L_N$ according to the first transformer output signal $S_{TXO}$. The lamp current balance module 2240*b* is coupled to the high voltage transformer 2235*b*, and is employed for respectively generating a plurality of output driving signals $S_1'$-$S_N'$ into each second terminal (another terminal) of the plurality of the lamps $L_1$-$L_N$ according to the second transformer output signal $S_{TXO}'$. Such design is meant to correspond to the condition of the lamps $L_1$-$L_N$ having longer lengths. Thus, the lamp driving module 2210 is designed to include two high voltage transformers 2235*a* and 2235*b* and two lamp current balance modules 2240*a* and 2240*b* for respectively driving the lamps $L_1$-$L_N$ directly from two opposite terminals of each lamp so that the luminance of every part of the lamps $L_1$-$L_N$ is closer to uniform. Please note that the backlight driving circuit 220 herein can be regarded as a push-push lamp driving circuit. The operations regarding other portions of circuitry shown in FIG. 2D are the same as those in FIG. 2A except for high voltage transformers 2235*a* and 2235*b* and two lamp current balance modules 2240*a* and 2240*b*.

Figure 3A:
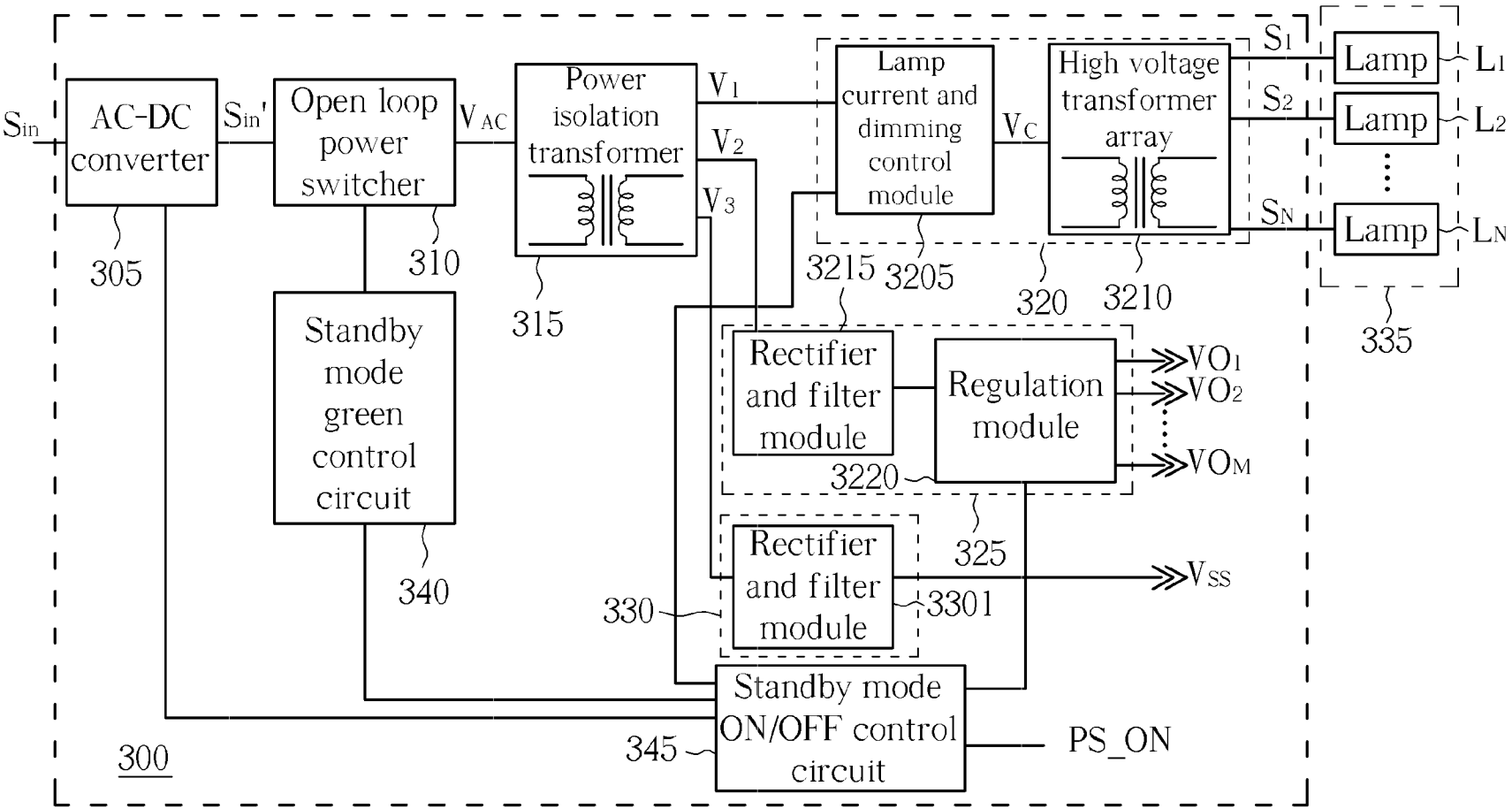
FIG. 3A is a diagram of a power apparatus according to a fifth exemplary embodiment of the present invention.

In other preferred exemplary embodiments, a backlight driving circuit, a system power, and a standby power are incorporated so that these three circuits share a same open loop power switcher and a same power isolation transformer. Please refer to FIGS. 3A-3D, which respectively illustrate fifth, sixth, seventh, and eighth exemplary embodiment of the power supply apparatus 300 according to the present invention. First of all, as shown in FIG. 3A, the power supply apparatus 300 includes an AC-DC converter 305, an open loop power switcher 310, a power isolation transformer 315, a backlight driving circuit 320, and two power circuits 325 and 330, wherein the operation and function regarding the AC-DC converter 305 shown in FIG. 3A are the same as those regarding the AC-DC converter 205 shown in FIG. 2A. The backlight driving circuit 320 and the backlight driving circuit 220 shown in FIG. 2A both have an identical design, respectively utilizing the backlight driving circuit 3210 and 2210 (or so called high voltage transformer array) to directly drive the lamps $L_1$-$L_N$. Also, the power circuit 325 for supplying the system power has an identical design with the power circuit 225 shown in FIG. 2A. It should be noted that the major difference between the exemplary embodiments shown in FIG. 3A and in FIG. 2A is that the power circuit 330 (which includes a rectifier and filter module 3301) utilized for providing the standby power in FIG. 3A is coupled to a third winding (not shown) of the power isolation transformer 315, and receives a third voltage signal $V_3$ generated from the third winding according to the AC input voltage $V_{AC}$ in order to generate an output power signal $V_{SS}$, thereby providing an output voltage of the standby power. In other words, the open loop power switcher 310, the power isolation transformer 315, and the power circuit 330 form the standby power of the power supply apparatus 300. The standby power and the lamp inverter (composed of the open loop power switcher 310, the power isolation transformer 315, and the backlight driving circuit 320) share the same open loop power switcher 310 and the same power isolation transformer 315. Moreover, for the standby function, the power supply apparatus 300 further comprises a standby mode green control circuit 340 and a standby mode ON/OFF control circuit 345, wherein when receiving a green control signal of the standby mode ON/OFF control circuit 345, the standby mode green control circuit 340 activates a corresponding green control configuration to control the operation of the open loop power switcher 310, thereby achieving the objective of energy saving. Meanwhile, the standby mode ON/OFF control circuit 345 also sends the green control signal to the AC-DC converter 305, the lamp current and dimming control module 3205, and the regulation module 325 which provides the system power in order to shutdown the output function of each circuit for the purpose of entering the green mode.

Figure 3B:
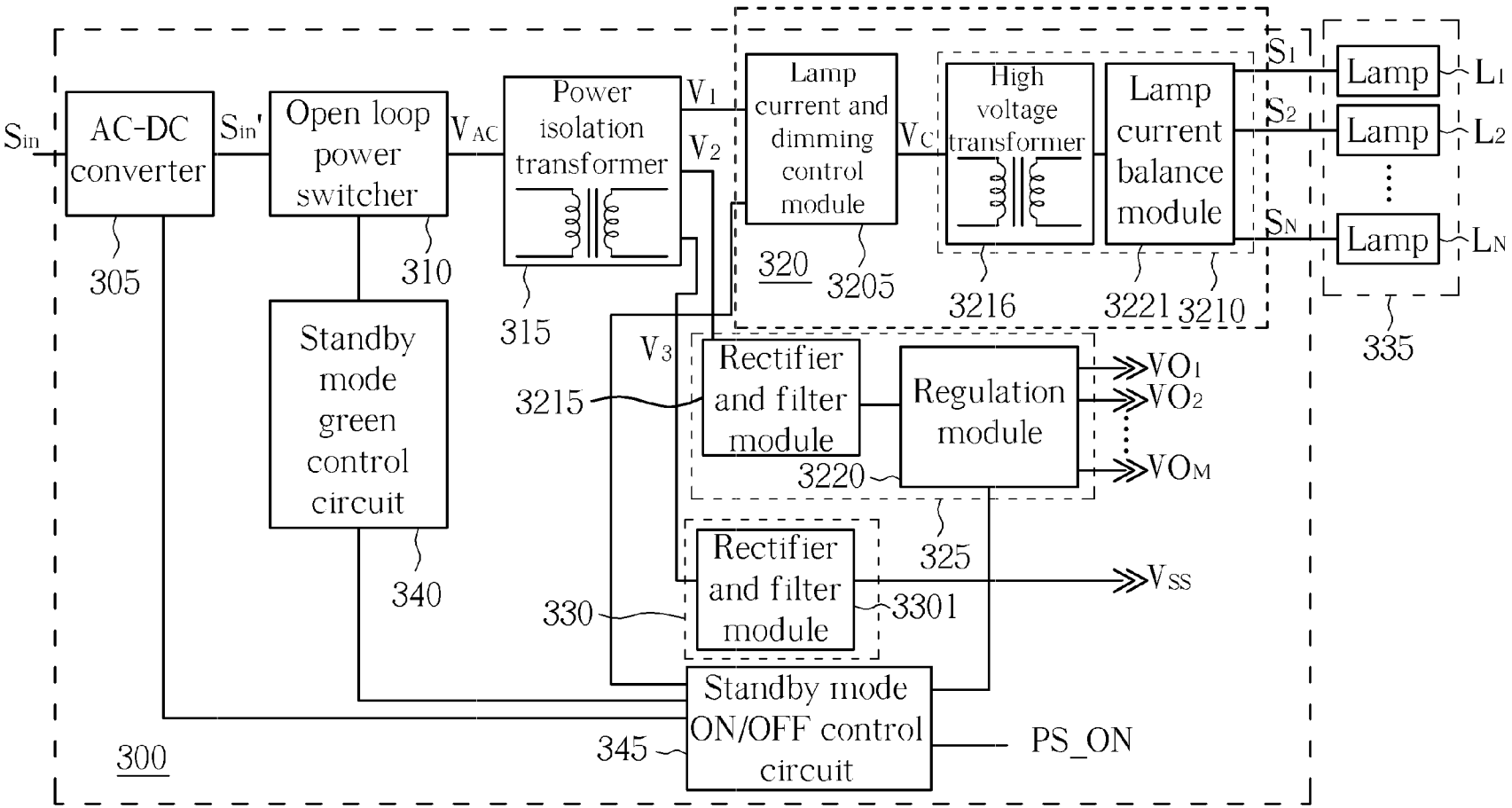
FIG. 3B is a diagram of a power apparatus according to a sixth exemplary embodiment of the present invention.

Please refer to FIG. 3B. The major difference between the exemplary embodiments shown in FIG. 3B and FIG. 3A is that the lamp driving module 3210 in FIG. 3B includes a high voltage transformer 3216 and a lamp current balance module 3221. Such design is different from the high voltage transformer array introduced in FIG. 3A. The operations and functions regarding the high voltage transformer 3216 and the lamp current balance module 3221 are respectively identical to those regarding the high voltage transformer 2216 and the lamp current balance module 2221 shown in FIG. 2B. Accordingly, the operations regarding other portions of circuitry of the power supply apparatus 300 shown in FIG. 3B are the same as those of the power supply apparatus 300 shown in FIG. 3A except for the high voltage transformer 3216 and the lamp current balance module 3221. Thus, detailed descriptions about the exemplary embodiment shown in FIG. 3B are omitted here.

Figure 3C:
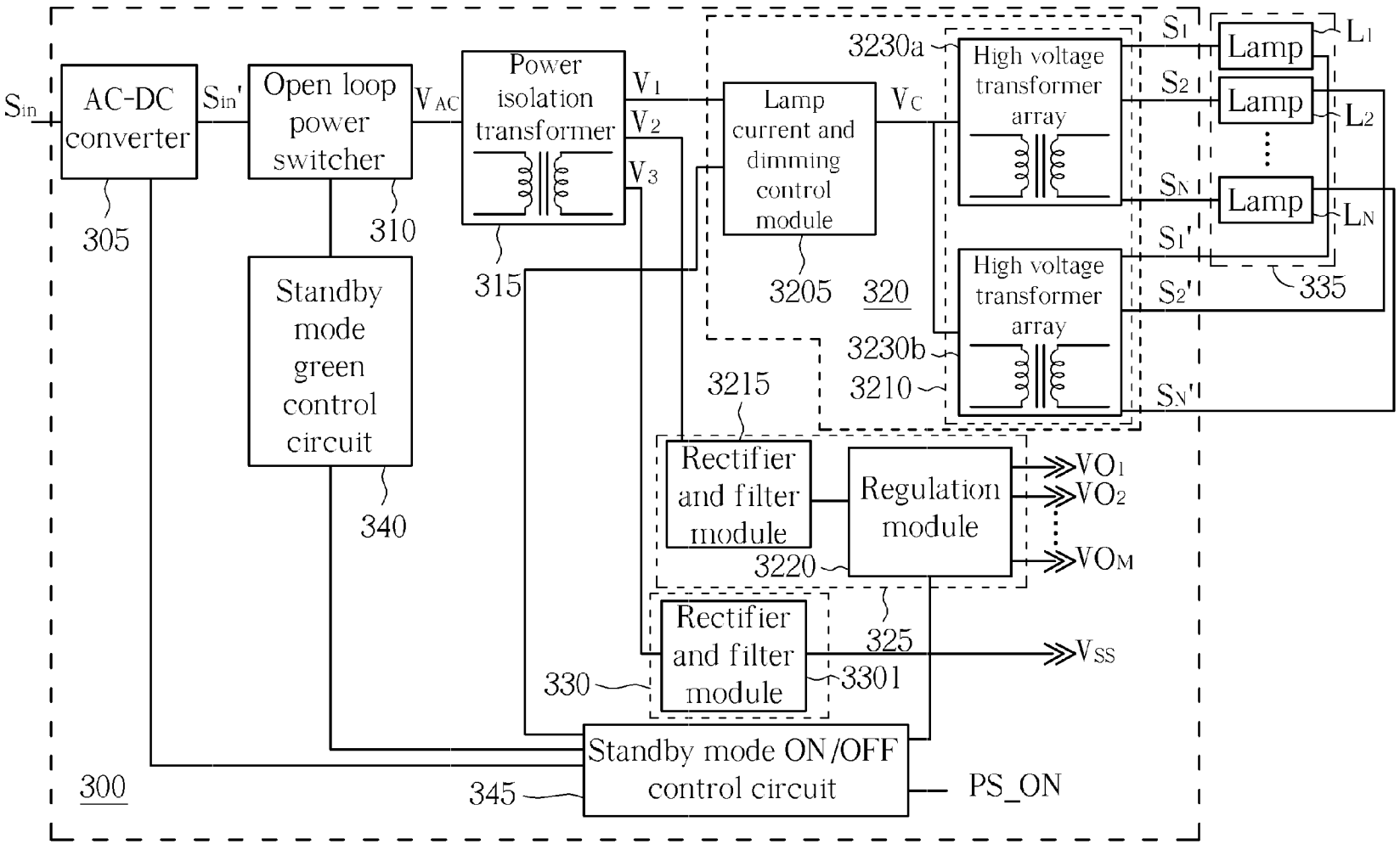
FIG. 3C is a diagram of a power apparatus according to a seventh exemplary embodiment of the present invention.

Additionally, as for the seventh embodiment of the present invention, the major difference between the exemplary embodiments in FIG. 3C and FIG. 3A is that the lamp driving module 3210 in FIG. 3C includes two high voltage transformer arrays 3230*a* and 3230*b*, which is meant to correspond to the condition of the backlight module 335 introducing lamps $L_1$~$L_N$ with longer length. Consequently, the lamp driving module 3210 is designed to include two high voltage transformer arrays 3230*a* and 3230*b* in order to respectively drive the lamps $L_1$-$L_N$ directly from two opposite terminals of each lamp so that the luminance of every part of the lamps $L_1$-$L_N$ is closer to uniform. Please note that the backlight driving circuit 320 herein can be regarded as a push-push lamp driving circuit. The operations and functions of the high voltage transformer arrays 3230*a* and 3230*b* shown in FIG. 3C are respectively the same as those of high voltage transformer arrays 2230*a* and 2230*b* shown in FIG. 2C, so detailed descriptions are omitted here for the sake of brevity. The operations regarding the other portions of circuitry of power supply apparatus 300 in FIG. 3C are the same as those of the power supply apparatus 300 in FIG. 3A except for the high voltage transformer arrays 3230*a* and 3230*b*, so detailed descriptions are omitted here.

Figure 3D:
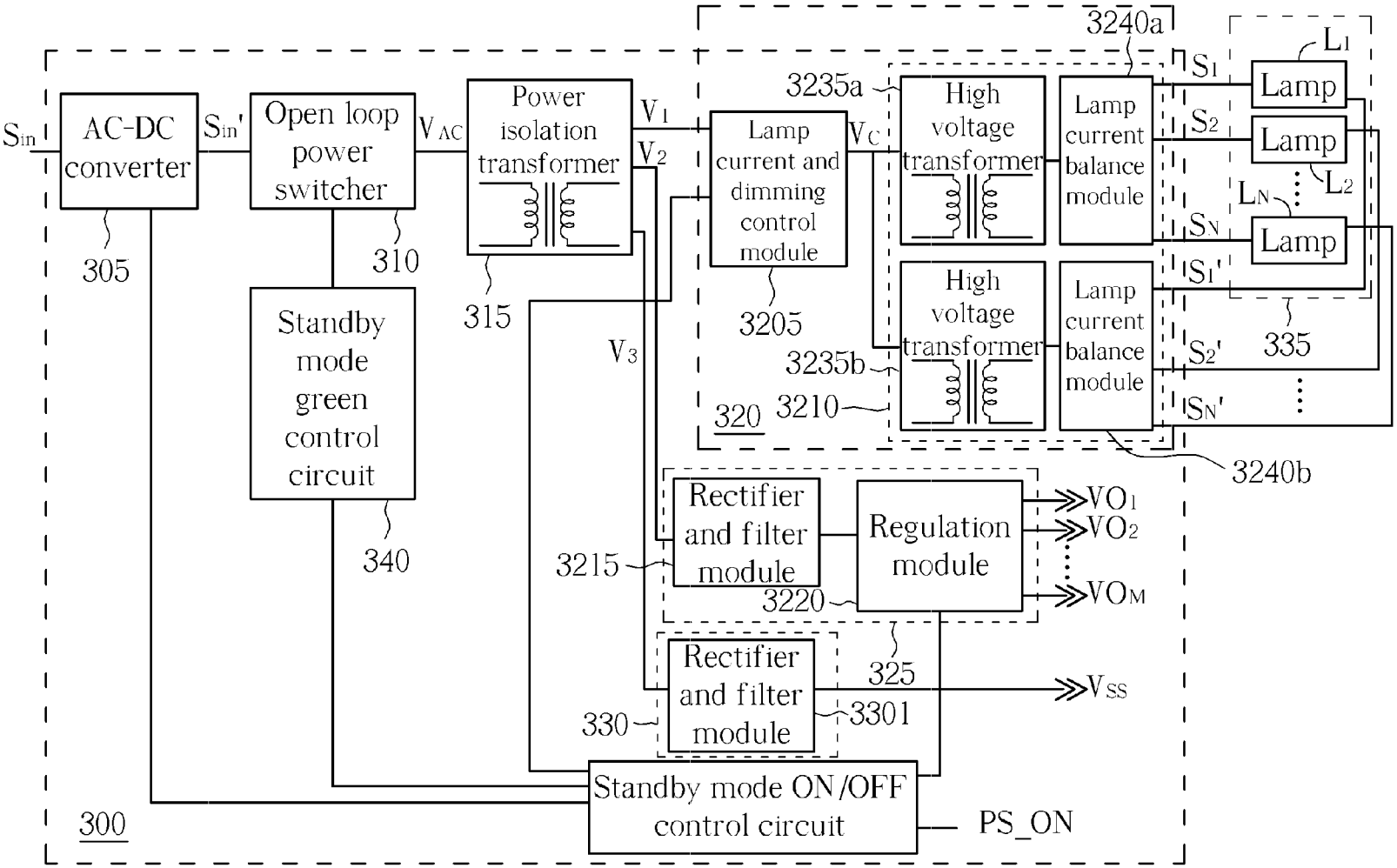
FIG. 3D is a diagram of a power apparatus according to an eighth exemplary embodiment of the present invention.

As for the eighth exemplary embodiment of the present invention, the major difference between the exemplary embodiments shown in FIG. 3D and in FIG. 3C is that the lamp driving module 3210 includes two high voltage transformers 3235*a* and 3235*b*, and two lamp current balance modules 3240*a* and 3240*b*, which is for handling the condition of the lamps $L_1$-$L_N$ having longer lengths. Thus, the lamp driving module 3210 is designed to include two high voltage transformers 3235*a* and 3235*b* and two lamp current balance modules 3240*a* and 3240*b*, for respectively driving the lamps $L_1$-$L_N$ directly from two opposite terminals of each lamp so that the luminance of every part of the lamps $L_1$-$L_N$ is closer to uniform. Please note that the backlight driving circuit 320 herein can be regarded as a push-push lamp driving circuit. The operations and functions of the high voltage transformers 3235*a* and 3235*b* and the lamp current balance module 3240*a* and 3240*b* shown in FIG. 3D are respectively the same as those of the high voltage transformers 2235*a* and 2235*b* and the lamp current balance modules 2240*a* and 2240*b* shown in FIG. 2D. Also, the operations regarding the other portions of circuitry of power supply apparatus 300 in FIG. 3D are the same as those of the power supply apparatus 300 in FIG. 3A except for the high voltage transformers 3235*a* and 3235*b* and the lamp current balance modules 3240*a* and 3240*b*, so detailed descriptions are omitted here for the sake of brevity.

Figure 4:
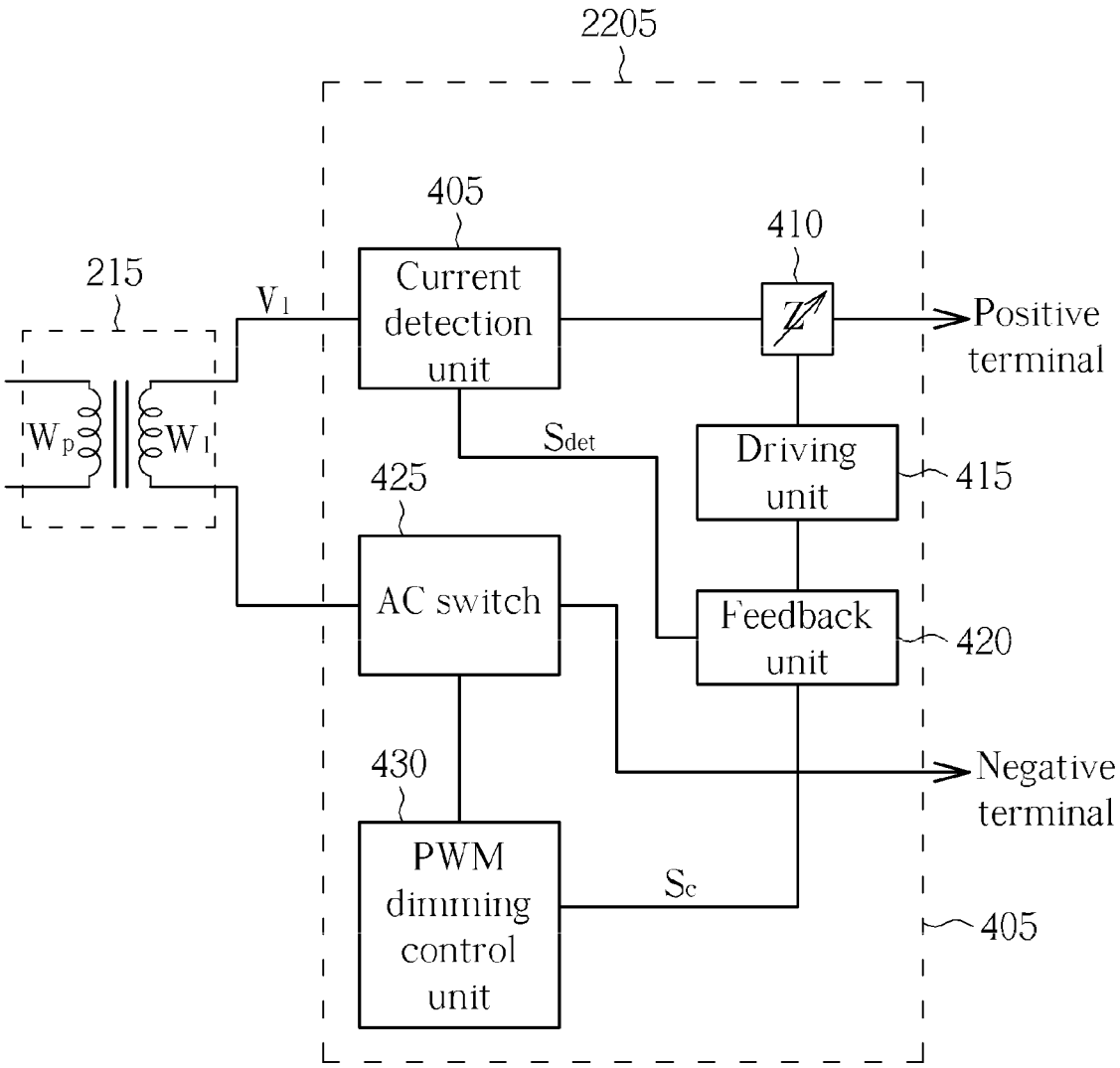
FIG. 4 is a diagram of a lamp current dimming and control module according to one exemplary embodiment of the present invention.

The lamp current and dimming control module 2205 described above in the first, second, third, and fourth exemplary embodiments can be further designed as the circuitry shown in FIG. 4. The lamp current and dimming control module 3205 described above in the fifth, sixth, seventh, and eighth exemplary embodiments can also be designed as the same circuitry shown in FIG. 4. Both these modifications fall within the scope of the present invention.

As shown in FIG. 4, the lamp current and dimming control module 2205 includes a current detection unit 405, a variable impedance unit 410 (which is implemented with a inductor), a driving unit 415, a feedback unit 420, an AC switch 425, and a pulse width modulation (PWM) dimming control unit 430, wherein the current detection unit 405 detects a current of the first voltage signal $V_1$ and accordingly generates a detection result $S_{det}$, which is fed back to the feedback unit 420. The two terminals of the variable impedance unit 410 are respectively coupled to the current detection unit 405 and a terminal (a positive terminal) of a transformer. It should be noted that the transformers in different exemplary embodiments may be distinct. For instance, the transformer in FIG. 2A is the high voltage transformer array 2210; the transformer in FIG. 2B is the high voltage transformer 2216; the transformer in FIG. 2C is the high voltage transformer array 2230*a*; and the transformer in FIG. 2D is the high voltage transformer 2235*a*. Additionally, the driving unit 415 is coupled to the variable impedance unit 410, and is employed for controlling an impedance of the variable impedance unit 410. The feedback unit 420 is coupled to the current detection unit 405 and the driving unit 415. The AC switch 425 is coupled to the first winding of the power isolation transformer 215 and another terminal (a negative terminal) of the above-mentioned transformer. The PWM dimming control unit 430 is coupled to the AC switch 425 and the feedback unit 420, is employed for controlling the ON/OFF timing of the AC switch 425 according to a PWM control mechanism, and is employed for generating a dimming control signal $S_C$ to the feedback unit 420, wherein the feedback unit 420 adjusts the impedance of the variable impedance unit 410 through the driving unit 415 by referencing the dimming control signal $S_C$ and the detection result $S_{det}$ in order to adjust the current of the first output driving signals $S_1$-$S_N$ which are employed for driving the lamps $L_1$-$L_N$. By means of the adjustment performed by the lamp current and dimming control module 2205, the objectives of improving the stability of lamp current and dimming are achieved.

Figure 5:
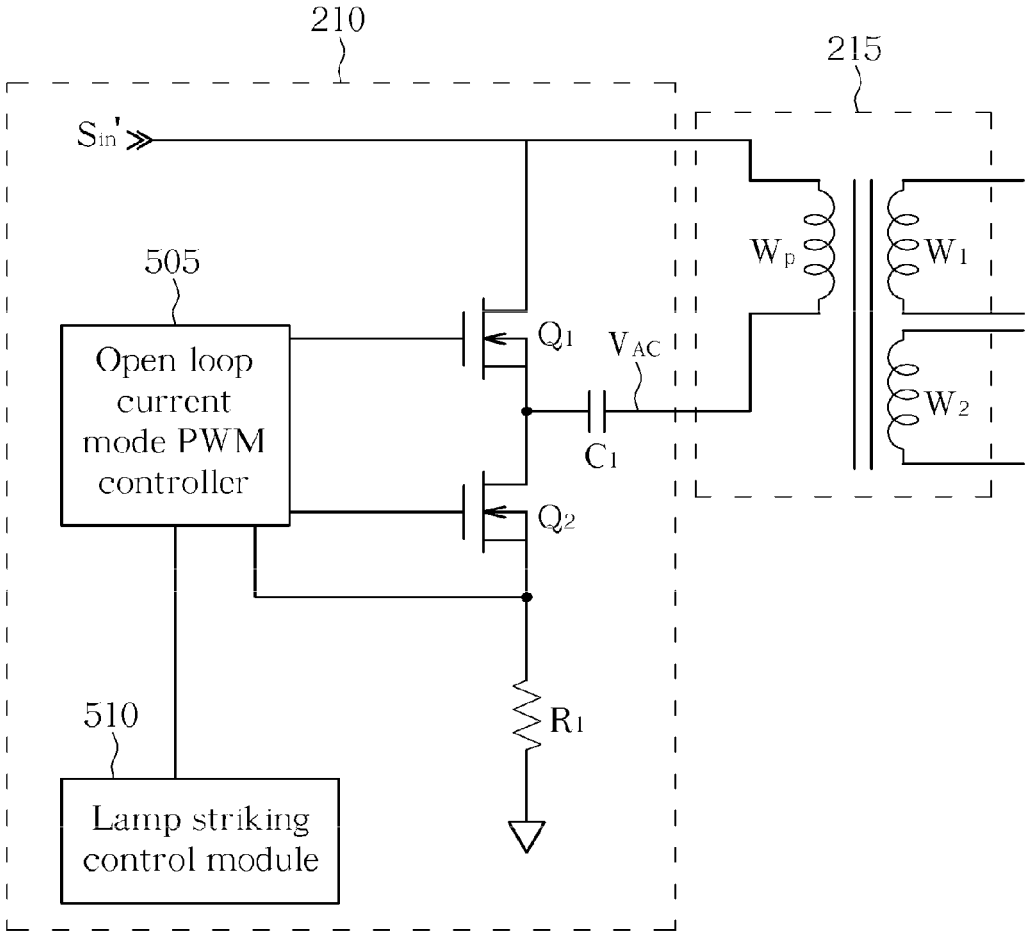
FIG. 5 is a diagram of an open loop power switcher according to one exemplary embodiment of the present invention.

Please refer to FIG. 5, which illustrates a diagram of an exemplary embodiment of the open loop power switcher 210 introduced in the first, second, third, and fourth exemplary embodiments described above. As shown in FIG. 5, the open loop power switcher 210 comprises at least two transistors $Q_1$ and $Q_2$, a capacitor $C_1$, a resistor $R_1$, an open loop current mode PWM controller 505, and a lamp striking (lighting) control module 510. The drain of the transistor $Q_1$ is coupled to the DC power $S_{in}$ and a terminal of the primary-side winding $W_p$ of the power isolation transformer 215 ($W_1$ and $W_2$ shown in the figure represent, respectively, the first winding and the second winding of the secondary-side); the source of the transistor $Q_1$ is coupled to the drain of the transistor $Q_2$ and the capacitor $C_1$; and the gate of the transistor $Q_1$ is coupled to the open loop current mode PWM controller 505. The drain of transistor $Q_2$ is also coupled to the capacitor $C_1$; the source is coupled to the resistor R1 and the open loop current mode PWM controller 505; and the gate of transistor $Q_2$ is also coupled to the open loop current mode PWM controller 505. Another terminal ($V_{AC}$) of the capacitor $C_1$ is coupled to another terminal ($V_{AC}$) of the primary-side winding $W_p$ of the power isolation transformer 215. One terminal of the resistor $R_1$ is coupled to the source of the transistor $Q_2$. Another terminal of the resistor $R_1$ is coupled to the ground. Also, the open loop current mode PWM controller 505 is employed for respectively controlling conductive states of the transistors $Q_1$ and $Q_2$. The lamp striking (lighting) control module 510 is coupled to the open loop current mode PWM controller 505 and is employed for controlling the open loop current mode PWM controller 505 in order to further control the lamp striking (lighting) procedure of lamps $L_1$-$L_N$. Even though this exemplary embodiment is explained with a half-bridge conversion scheme, the open loop power switcher 210 is not limited to this kind of conversion scheme, and could also be a full-bridge conversion scheme.

Compared to the conventional switching power supply apparatus 100, the conventional switching power supply apparatus 100 performs dimming control when lamp striking (lighting). Accordingly, the load variation caused by the lamp will be fed back to the conventional power switcher 125*a* through the feedback and control circuit 140*a*, causing power instability. However, the open loop power switcher 210 shown in FIG. 5 is designed as an open loop circuit, which prevents the system power instability caused by load variation. As a result, the above-mentioned problems are eliminated, and the open loop current mode PWM controller 505 is designed into a current mode control mechanism of 50% duty cycle, which is capable of controlling the power conversion efficiency to be at its best level, thereby giving the present invention the advantage of very high power conversion efficiency. The present invention therefore accomplishes the objective of zero voltage switching, and is able to limit the peak power output within a reasonable range. Even though the open loop power switcher theoretically makes lamp dimming more difficult than before, the present invention introduces a lamp current and dimming control module 2205 disposed at the secondary-side of the power isolation transformer 215 for performing lamp dimming, thereby overcoming this difficulty. As described previously, the open loop power switcher 210 can also be implemented with a full bridge conversion scheme and in the fifth, sixth, seventh, and eighth exemplary embodiments, the open loop power switcher 310 can also be implemented with the same circuitry as the open loop power switcher 210 shown in FIG. 5. All modifications mentioned here fall within the scope of the present invention.

Moreover, person skilled in the art should be capable of devising the implementations of only the lamp inverter and the standby power sharing a same open loop power switcher and a same power isolation transformer after reading the teachings of the present invention. Accordingly, exemplary embodiments set forth can be properly modified to be applied to a backlight module composed of a single lamp, or a backlight module composed of other similar backlight components, which also conforms to the spirit of the present invention. Alternatively, in the foregoing exemplary embodiments, the regulator module 2220/3220 which supplies voltages $VO_1$-$VO_M$ required by the system power are optional components; that is, the power circuit 225 could be implemented without the regulator module 2220 in another exemplary embodiment and the power circuit 325 could be implemented without the regulator module 3220 in another exemplary embodiment. These modifications also fall within the scope of the present invention.

Those skilled in the art will readily observe that numerous modifications and alterations of the device and method may be made while retaining the teachings of the invention.

What is claimed is:

1. A power supply apparatus, comprising:

an alternating current (AC) to direct current (DC) converter;

an open loop power switcher connected to the AC to DC converter, for providing an alternating current (AC) input voltage according to a DC power outputted by the AC to DC converter;

a power isolation transformer, coupled to the open loop power switcher, having a primary-side winding, a first winding, and a second winding, wherein the first and second windings are disposed at a secondary-side of the power isolation transformer and the first winding is employed for generating a first voltage signal according to the AC input voltage;

a backlight driving circuit, coupled to the first winding of the power isolation transformer, for driving a backlight module according to the first voltage signal; and a power circuit, coupled to the second winding of the power isolation transformer, for receiving a second voltage signal generated from the second winding according to the AC input voltage in order to generate an output power signal;

wherein the open loop power switcher is disconnected from the backlight module receiving no feedback from the backlight module.

2. The power supply apparatus of claim 1, wherein the backlight module comprises at least a lamp.

3. The power supply apparatus of claim 2, wherein the open loop power switcher, the power isolation transformer, and the backlight driving circuit form a lamp inverter for the power supply apparatus; the open loop power switcher, the power isolation transformer, and the power circuit form a system power of the power supply apparatus; and the lamp inverter and the system power share the open loop power switcher and the power isolation transformer.

4. The power supply apparatus of claim 2, wherein the open loop power switcher, the power isolation transformer, and the backlight driving circuit form a lamp inverter of the power supply apparatus; the open loop power switcher, the power isolation transformer, and the power circuit form a standby power of the power supply apparatus; and the lamp inverter and the standby power share the open loop power switcher and the power isolation transformer.

5. The power supply apparatus of claim 2, wherein the backlight driving circuit comprises:

a lamp current and dimming control module, for receiving the first voltage signal to generate a control signal, wherein the control signal is employed to control a current and an luminance regarding the lamp while driving the lamp; and a lamp driving module, coupled to the lamp current and dimming control module, for generating at least a first driving signal to drive the lamp according to the control signal.

6. The power supply apparatus of claim 5, wherein the lamp driving module comprises:

a transformer array, for generating a plurality of first output driving signals to drive a plurality of the lamps according to the control signal.

7. The power supply apparatus of claim 5, wherein the lamp driving module comprises:

a transformer, coupled to the lamp current and dimming control module, for generating a first transformer output signal according to the control signal; and a lamp current balance module, coupled to the transformer, for generating a plurality of first output driving signals to drive a plurality of the lamps according to the transformer output signal.

8. The power supply apparatus of claim 5, wherein the lamp driving module comprises:

a first transformer, coupled to the lamp current and dimming control module, for generating a first transformer output signal according to the control signal;

a second transformer, coupled to the lamp current and dimming control module, for generating a second transformer output signal according to the control signal;

a first lamp current balance module, coupled to the first transformer, for respectively generating a plurality of first output signals into each of first terminals of a plurality of the lamps; and a second lamp current balance module, coupled to the second transformer, for respectively generating a plurality of second output signals into each of second terminals of a plurality of the lamps.

9. The power supply apparatus of claim 5, wherein the lamp driving module comprises:

a first transformer, coupled to the lamp current and dimming control module, for generating at least a first transformer output signal to a first terminal of the lamp according to the control signal;

a second transformer, coupled to the lamp current and dimming control module, for generating at least a second transformer output signal to a second terminal of the lamp according to the control signal;

wherein the backlight driving circuit is a push-push lamp inverter.

10. The power supply apparatus of claim 9, wherein the first transformer is a transformer array, for respectively generating a plurality of the first transformer output signals into each of the first terminals of a plurality of the lamps according to the control signal, and the second transformer is a second transformer array, for respectively generating a plurality of the second transformer output signals into each of the second terminals of the plurality of the lamps according to the control signal.

11. The power supply apparatus of claim 5, wherein the lamp driving module comprises at least a transformer, and the lamp current and dimming control module comprises:

a current detection unit, for detecting a current of the first voltage signal to generate a detection result;

a variable impedance unit, having one terminal coupled to the current detection unit and another terminal coupled to a terminal of the transformer;

a driving unit, coupled to the variable impedance unit, for controlling an impedance of the variable impedance unit;

a feedback unit, coupled to the current detection unit and the driving unit;

an AC switch, coupled to the first winding of the power isolation transformer and another terminal of the transformer; and a pulse width modulation (PWM) dimming control unit, coupled to the AC switch and the feedback unit, for controlling an ON/OFF timing of the AC switch according to a PWM mechanism, and outputting a dimming control signal to the feedback unit, wherein the feedback unit adjusts the impedance of the variable impedance unit through the driving unit by referencing the dimming control signal and the detection unit.

12. The power supply apparatus of claim 2, wherein the open loop power switcher comprises:

a first transistor, having a first terminal, a second terminal, and a control terminal, wherein the first terminal is coupled to a terminal of the primary-side winding of the power isolation transformer and the DC power;

a second transistor, having a first terminal, a second terminal, and a control terminal, wherein the first terminal is coupled to the second terminal of the first transistor;

a capacitor, a terminal of the capacitor being coupled to another terminal of the primary-side winding of the power isolation transformer, and another terminal of the capacitor being coupled to the second terminal of the first transistor and the first terminal of the second transistor;

a resistor, coupled to the second terminal of the second transistor and a reference voltage level;

an open loop current mode PWM controller, coupled to the control terminal of the first transistor, the control terminal of the second transistor, and the resistor, for controlling conductive states of the first and second transistors; and a lamp striking (lighting) control module, coupled to the open loop current mode PWM controller, for controlling the open loop current mode PWM controller to light the lamp.

13. The power supply apparatus of claim 1, wherein the power circuit comprises:

a rectifier and filter circuit, coupled to the second winding of the power isolation transformer for rectifying the second voltage signal and filtering the rectified second voltage signal to provide the output power signal.

14. The power supply apparatus of claim 13, wherein the power circuit further comprises:

a regulation module coupled to the rectifier and filter module, for regulating the output power signal generated from the rectifier and filter module.

* * * * *